US009284739B2

(12) United States Patent
Behr et al.

(10) Patent No.: US 9,284,739 B2
(45) Date of Patent: Mar. 15, 2016

(54) APPARATUS AND METHOD FOR REPAIRING A STEEL DOOR FRAME

(71) Applicant: SCI-PRO.ORG, LLC, Saline, MI (US)

(72) Inventors: Scott Allen Behr, Howell, MI (US); Kevin John Rucinski, Saline, MI (US)

(73) Assignee: Sci-Pro.Org, LLC, Saline, MI (US)

( * ) Notice: Subject to any disclaimer, the term of this patent is extended or adjusted under 35 U.S.C. 154(b) by 0 days.

(21) Appl. No.: 14/522,707

(22) Filed: Oct. 24, 2014

(65) Prior Publication Data

US 2015/0113897 A1 Apr. 30, 2015

Related U.S. Application Data

(60) Provisional application No. 61/895,659, filed on Oct. 25, 2013.

(51) Int. Cl.
*E04G 23/02* (2006.01)
*E06B 1/34* (2006.01)
*E06B 1/12* (2006.01)

(52) U.S. Cl.
CPC ..... *E04G 23/0277* (2013.01); *E06B 1/347* (2013.01); *E06B 1/12* (2013.01)

(58) Field of Classification Search
CPC ..... E06B 1/12; E06B 1/14; E06B 1/16; E06B 1/18; E06B 1/20
USPC ..... 52/514, 211, 212
See application file for complete search history.

(56) References Cited

U.S. PATENT DOCUMENTS 1,050,924 A * 1/1913 Dowd ..... 49/505
2,835,933 A * 5/1958 Evans ..... E06B 1/52 52/211
3,420,003 A * 1/1969 Cline ..... E06B 1/20 49/505
3,793,788 A * 2/1974 Collins ..... E06B 1/6061 52/211
4,223,494 A * 9/1980 Wendt ..... E06B 1/52 49/504
4,510,722 A * 4/1985 van Wieringen ..... E06B 1/603 49/505
4,674,248 A * 6/1987 Hall ..... E06B 5/16 49/504
4,698,944 A * 10/1987 Wilkins, Jr. ..... E06B 1/603 49/504
4,873,804 A * 10/1989 Kukke ..... E06B 1/6076 411/116
4,878,325 A * 11/1989 Van Tuyl ..... E06B 1/20 49/505
5,573,354 A 11/1996 Koch
5,636,482 A 6/1997 Klager
5,873,209 A 2/1999 Hagel
6,378,263 B1 * 4/2002 Sobers ..... E04G 23/0203 52/443
6,425,222 B1 7/2002 Hagel
6,694,696 B2 2/2004 Hagel
7,543,864 B2 6/2009 Barthel
7,866,113 B2 1/2011 Young
2004/0098940 A1 * 5/2004 Latessa ..... E04F 21/003 52/514
2009/0077909 A1 3/2009 Barthel
2010/0126088 A1 5/2010 Young

* cited by examiner

*Primary Examiner* — Brian Glessner
*Assistant Examiner* — Adam Barlow
(74) *Attorney, Agent, or Firm* — Young Basile Hanlon & MacFarlane P.C.

(57) ABSTRACT

An apparatus and method for repairing a damaged door frame, wherein a jamb patch has a first portion adaptable to replace a removed section of the door frame and a second portion coupled to the first portion and adaptable to fit behind a remaining section of the door frame to align the first portion with the remaining section of the door frame. The second portion of the jamb patch may be slidably coupled to the first portion for location into a first position, wherein the first portion of the jamb patch overlaps the second portion, and into a second position, wherein the second portion of the jamb patch extends from the first portion. Alternatively, the second portion of the jamb patch may fixedly extend from the first portion of the jamb patch.

20 Claims, 10 Drawing Sheets

APPARATUS AND METHOD FOR REPAIRING A STEEL DOOR FRAME

CROSS-REFERENCE TO RELATED APPLICATIONS

This application claims benefit of U.S. Provisional Application Ser. No. 61/895,659, filed on Oct. 25, 2013, which is incorporated herein in its entirety by reference.

TECHNICAL FIELD

This disclosure relates to an apparatus and method for repairing a damaged door frame, and more particularly, an apparatus and method for repairing damaged sections of a steel door frame without having to replace the entire steel door frame.

BACKGROUND

Door systems with welded steel door frames are widely used in numerous commercial, municipal, industrial, hospitality, retail and other building applications. Steel door frames are used both to frame interior openings (e.g., office, classroom, bathroom, etc. openings) and exterior openings (e.g., entry and exit openings). Steel door frames and their doors may be manufactured from cold rolled steel (CRS), galvanized steel, or galvannealed steel, for example. These doors and frames are valued for their strength, long service life, and one-piece finished appearance.

Once installed, both exterior and interior steel door frames may be susceptible to damage. For example, a steel door frame may become corroded. The exterior surfaces of a steel door frame are usually provided with a finish coat of primer or paint, helping to protect the exterior surfaces from weather, corrosive chemicals used to clean areas around the frame (e.g., cleaners in a hospital), and other environmental conditions (e.g., humidity or salt). If the interior surfaces of the steel door frame are coated with primer or paint, the same level of protection is afforded those surfaces as the exterior surfaces. Often, however, these interior surfaces may only be coated with primer, if at all.

Therefore, in the presence of moisture inside the steel door frame, many steel door frames are susceptible to corrosion from the inside out. This moisture may be present in the form of atmospheric humidity, water from cleaning, or leaks in a building structure, for example. Because the interior surfaces of the door frame are enclosed, the moisture may take a prolonged time to dissipate, exposing the interior surfaces to moisture for a long period of time. This enclosed condition may be further aggravated in buildings where a concrete or block wall is built adjacent to the steel door frame. In these applications, the steel door frame is often "slushed" (i.e., filled with masonry mix). While this provides for a robust installation of the steel door frame, the masonry mix can hold moisture within its porous structure, and thus, the moisture may in turn be placed in direct contact with the steel door frame for a prolonged period of time. This provides a humidity rich environment for corrosion to begin.

Steel door frames are also susceptible to other types of damage. For example, a steel door frame may suffer damage in a forced entry event, typically in the section of the steel door frame containing its strike. Certain steel door frames may also be damaged as the result of design or construction errors. For instance, when necessary reinforcements are inadvertently left out of critical sections of the steel door frame (e.g., at the section of the steel door frame where the door closer is mounted), those sections may become weakened and vulnerable to early failure.

Irrespective of the cause of damage, when damage to a steel door frame is identified, and a determination is made that the door frame requires repair, the usual solution is to completely remove the steel door frame and replace it with a new one. This is an inefficient and costly solution to a common problem and is therefore undesirable in the building industry. Thus, it would be desirable to provide an apparatus and method to repair a steel door frame without having to replace the entire steel door frame.

SUMMARY

The present invention provides an apparatus for repairing a damaged door frame that provides a jamb patch having a first portion adaptable to replace a removed section of the door frame and a second portion coupled to the first portion. The second portion of the jamb patch is adaptable to fit behind a remaining section of the door frame to assist in aligning the first portion of the jamb patch with the remaining section of the door frame. The second portion of the jamb patch may fixedly extend from the first portion of the jamb patch. The second portion of the jamb patch may also be slidably coupled to the first portion of the jamb patch for movement between a first position, wherein the first portion of the jamb patch overlaps the second portion of the jamb patch, and a second position, wherein the second portion of the jamb patch extends from the first portion of the jamb patch. The first portion of the jamb patch may include at least one aperture extending therethrough, wherein a fastener may extend through the at least one aperture for securing the second portion of the jamb patch in the second position. The first portion of the jamb patch may include at least one elongate channel to permit access to the second portion of the jamb patch to allow for adjusting the second portion of the jamb patch between the first portion and the second position. The second portion of the jamb patch may include at least one slot in alignment with the at least one elongate channel to assist with adjusting the second portion of the jamb patch between the first position and the second position. The first portion of the jamb patch may have a substantially U-shaped configuration similar to the remaining section of the door frame, wherein the U-shaped configuration has a pair of free ends. A plate is connectable to the pair of free ends of the first portion of the jamb patch, and the plate has an aperture extending therethrough. The first portion of the jamb patch also has an aperture extending therethrough. A substantially cylindrical tube is connected to the plate and the first portion of the jamb patch and extends between and is in communication with the aperture of the plate and the aperture of the first portion of the jamb patch. The substantially cylindrical tube is adaptable to receive a fastener to assist with securing the jamb patch in the place of the removed section of the door frame. The second portion of the jamb patch may provide a surface engageable with a filler compound. The first portion of the jamb patch and the second portion of the jamb patch may have substantially the same configuration.

The present invention may also include a method of repairing a damaged door frame comprising the steps of positioning a first portion of a jamb patch in the place of a removed section of the door frame, with the first portion being sized and shaped to match the outer contour of the door frame, and positioning a second portion of the jamb patch behind a remaining section of the door frame. The method may also include aligning the first portion of the jamb patch with the remaining section of the door frame. The second portion of the jamb patch may fixedly extend from the first portion of the jamb patch. When the second portion of the jamb patch is fixedly extended from the first portion of the jamb patch, the method may also include rotating the jamb patch to position the second portion into position behind the remaining section of the door frame while the first portion of the jamb patch is positioned in the place of the removed section of the door frame. A repair compound may be applied to an area between the first portion of the jamb patch and the remaining section of the door frame, using the second portion as a backing surface for the repair compound. The method may also include sliding the second portion of the jamb patch relative to the first portion of the jamb patch for movement between a first position, wherein the first portion of the jamb patch overlaps the second portion of the jamb patch, and a second position, wherein the second portion of the jamb patch extends from the first portion of the jamb patch. When the second portion of the jamb patch is slidably coupled to the first portion, the second portion may slide into position behind the remaining section of the door frame after the first portion of the jamb patch is positioned in the place of the removed section of the door frame. The first portion of the jamb patch may have a substantially U-shaped configuration similar to the remaining section of the door frame. The substantially U-shaped configuration has a pair of free ends. When the first portion of the jamb patch has a substantially U-shaped configuration, a plate may be connected to the pair of free ends of the first portion of the jamb patch, wherein the first portion of the jamb patch and the plate each have an aperture extending therethrough. A substantially cylindrical tube is connected to the plate and the first portion of the jamb patch, wherein the substantially cylindrical tube extends between and is in communication with the aperture of the plate and the aperture of the first portion of the jamb patch. A fastener is inserted through the substantially cylindrical tube to secure the jamb patch to the underlying wall structure in the place of the removed section of the door frame.

BRIEF DESCRIPTION OF THE DRAWINGS

The various features, advantages and other uses of the present apparatus and method will become more apparent by referring to the following detailed description and drawings in which.

DETAILED DESCRIPTION

Typically, once a determination is made that a steel door frame requires repair, the steel door frame is removed and replaced with a new steel door frame. Even if the steel door frame itself is not prohibitively expensive, the total cost of removing and replacing the entire steel door frame can be significant, depending on how the steel door frame was originally installed. Moreover, since not all door frame sizes are readily available, there may be a long lead time associated with replacing a steel door frame. This approach, although functionally effective, can waste money, time, and materials if much of the steel door frame is still structurally sound and otherwise functional. The apparatus and method for repairing a steel door frame of the present invention provides for the repair of only the damaged section of the steel door frame, thus extending the useful service life of the functional remainder of the steel door frame. With the repair area isolated to the damaged section of the steel door frame, the total cost, lead time, and materials associated with the repair of the damaged steel door frame can be reduced as compared to removing and replacing the entire steel door frame. As shown in an installed position in FIG. 1, the relatively small size of a jamb patch 10 of the present invention, as compared to a steel door frame 22 as a whole, allows the jamb patch 10 to be easily transported, for example, in a repair vehicle or by courier service. In some instances, isolated repair of the damaged section of the steel door frame 22 can also avoid the need to comply with intervening building codes and regulations that the building owner would be subjected to if the entire steel door frame 22 were removed and replaced.

Figure 2:
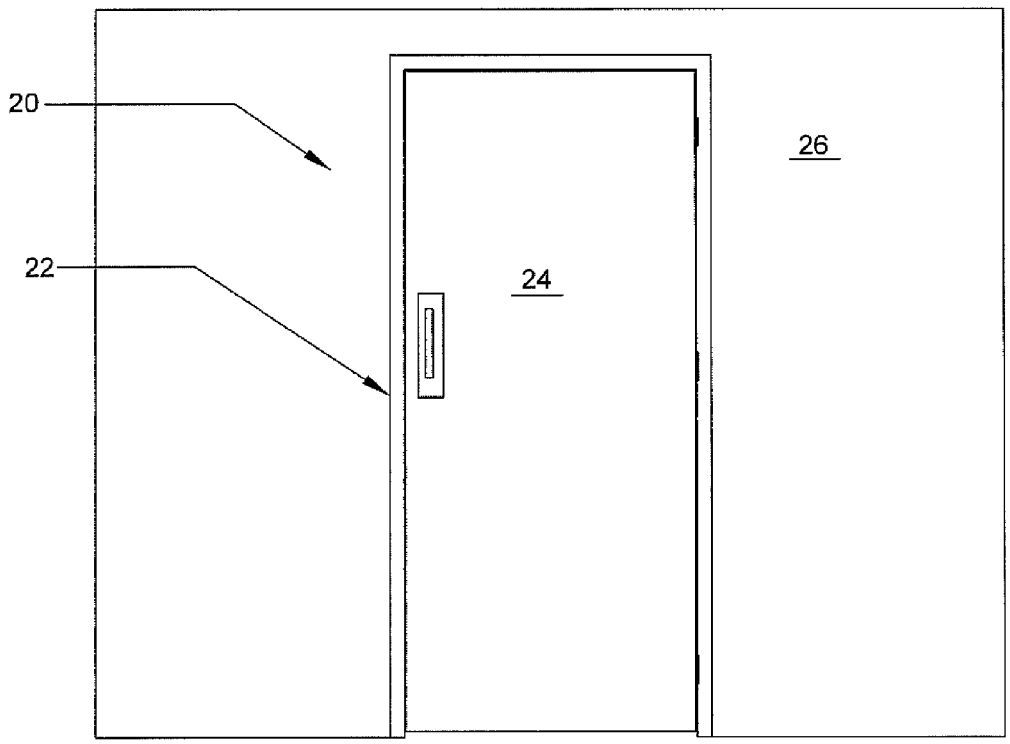
FIG. 2 is a front view of the steel door frame of FIG. 1 for installing the apparatus and method for repairing the steel door frame of the present invention.

The details of the configuration and installation of the jamb patch 10 are described with additional reference to a door system 20, shown in FIG. 2. The door system 20 includes a welded steel door frame 22 that houses and supports a steel door 24. The steel door frame 22 is installed into a surrounding wall structure 26 that frames an entrance and exit opening. The wall structure 26 can be constructed from masonry, for example, or other conventional building materials. Although this disclosure refers to the steel door frame 22 as being fabricated from a steel material, it will be understood that the jamb patch 10 of the present invention may be used to repair damaged steel door frames 22 composed of other materials as well.

Figure 3:
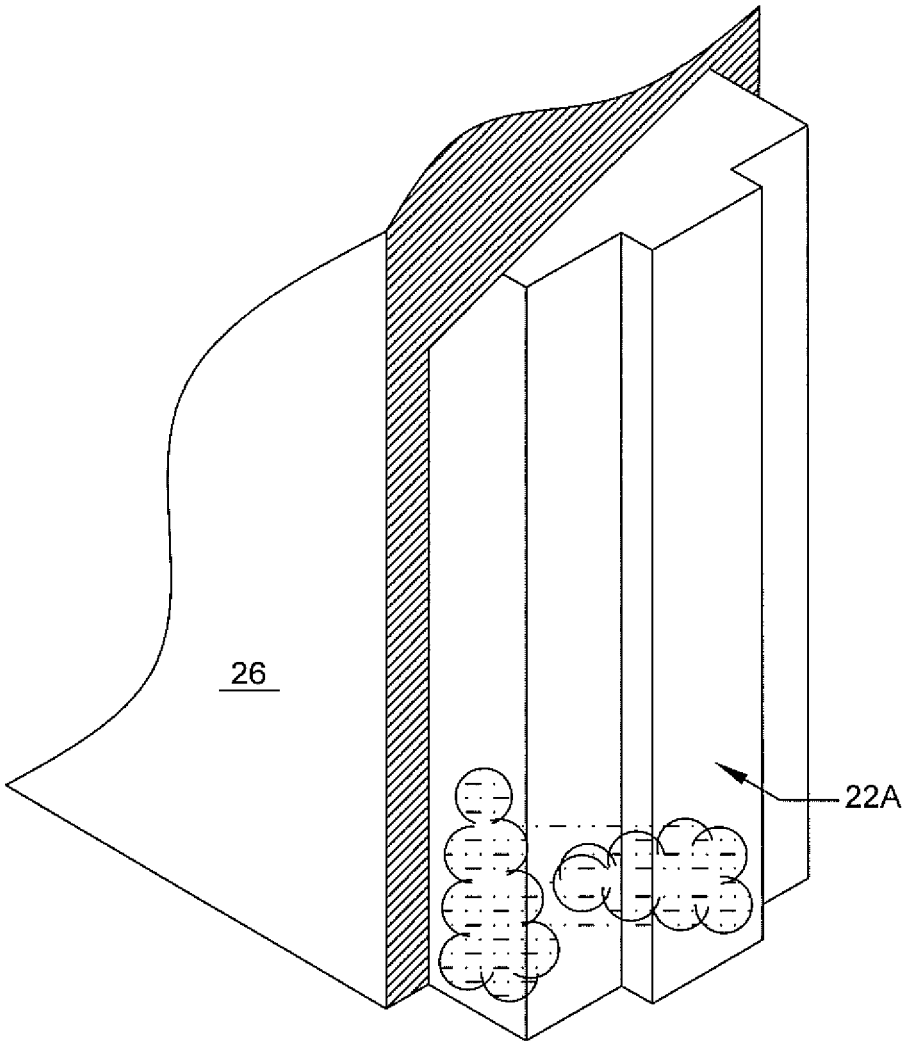
FIG. 3 is a perspective view of the steel door frame of FIG. 2 showing a corroded section that is replaced by the apparatus and method for repairing the steel door frame of the present invention.

The jamb patch 10 of the present invention may be used to repair a damaged section 22*a* of the steel door frame 22, as represented in FIG. 3. In the illustrated example, the damaged section 22*a* exhibits corrosion damage, which is typically located at the bottommost section of the steel door frame 22. However, it will be understood that the steel door frame 22 may be susceptible to corrosion damage at other sections as well, and that the location of the damaged section 22*a* of the steel door frame 22 can vary accordingly. Furthermore, in other examples, the damaged section 22*a* of the steel door frame 22 can exhibit other types of damage. For instance, the damaged section 22*a* of the steel door frame 22 can exhibit damage arising from a forced entry event or from the result of design or construction errors. As with the example of corrosion damage, it will be understood that the steel door frame 22 may be susceptible to these or other types of damages at sections of the steel door frame 22 other than the bottommost section.

Figure 1:
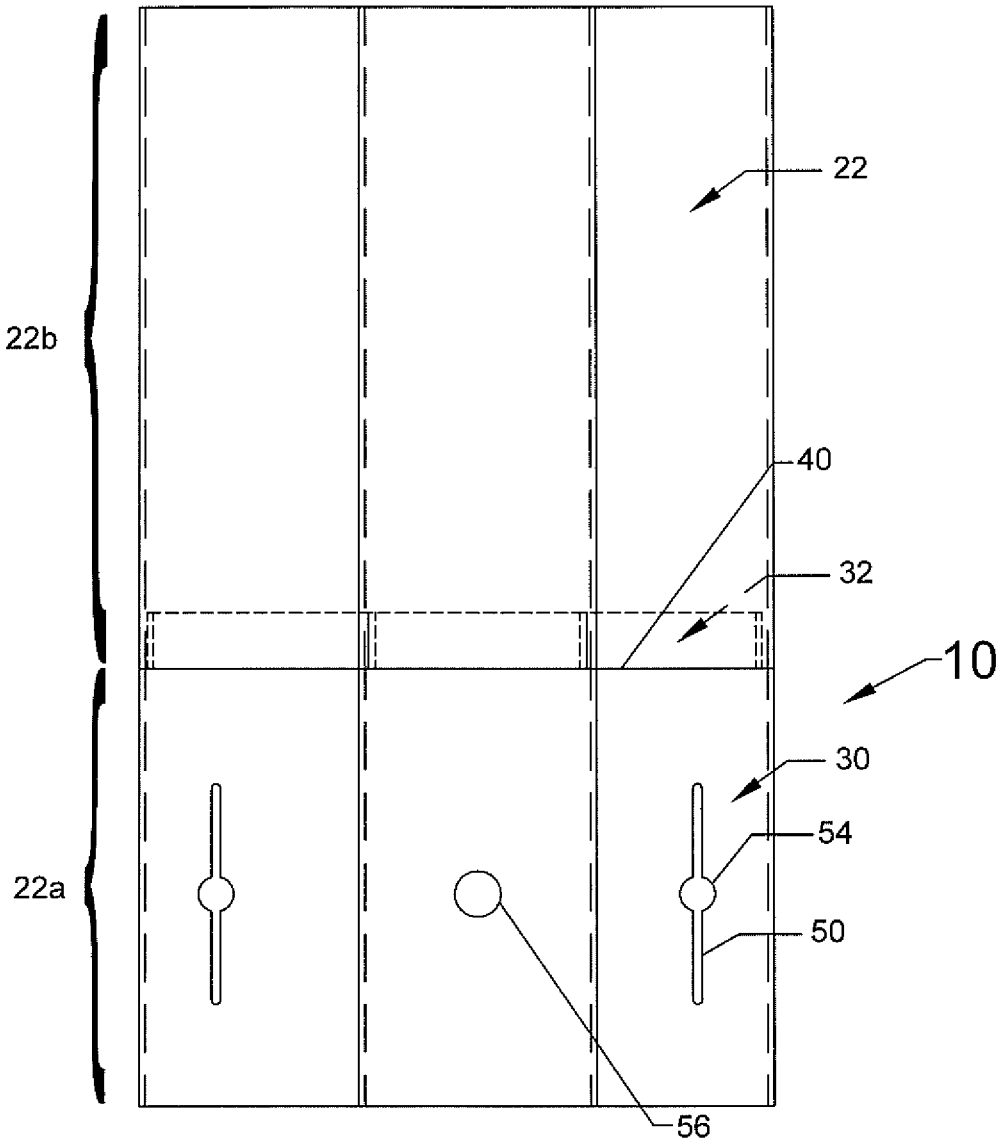
FIG. 1 is a front view of a jamb patch of the apparatus and method for repairing a steel door frame of the present invention.

As shown in FIG. 1, the jamb patch 10 is generally configured for replacing the damaged section 22*a* of the steel door frame 22 after the damaged section 22*a* has been identified and removed. The damaged section 22*a* of the steel door frame 22 may be removed by cutting the damaged section 22*a* away from the remaining section 22*b* of the steel door frame 22 or by removing the damaged section 22*a* through other conventional methods.

Figure 4:
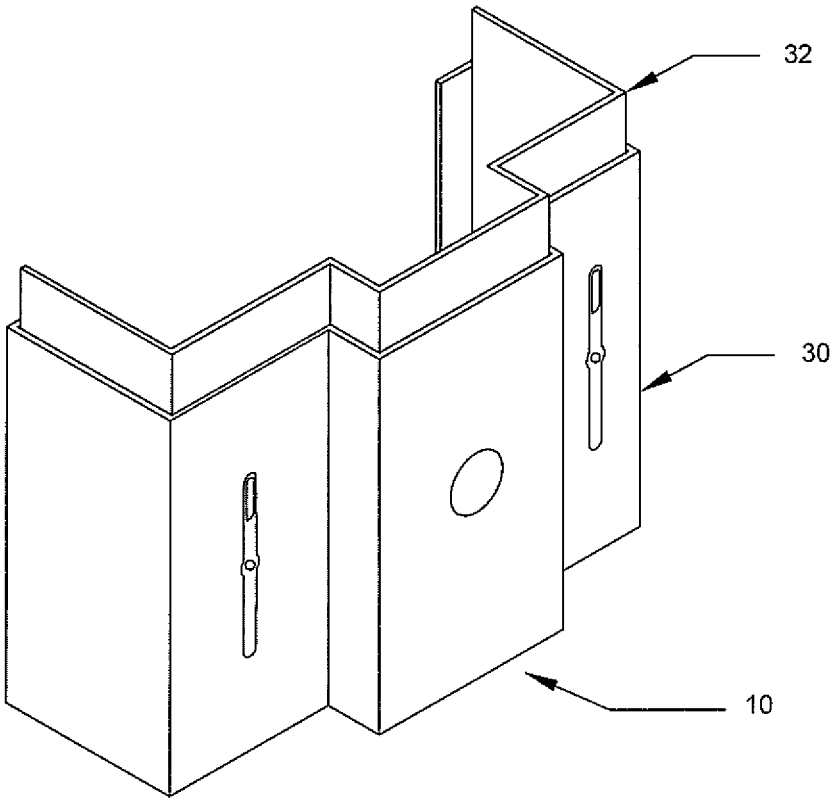
FIG. 4 is a perspective view of the jamb patch of the apparatus and method for repairing the steel door frame of the present invention showing a first portion and a second portion.
Figure 5:
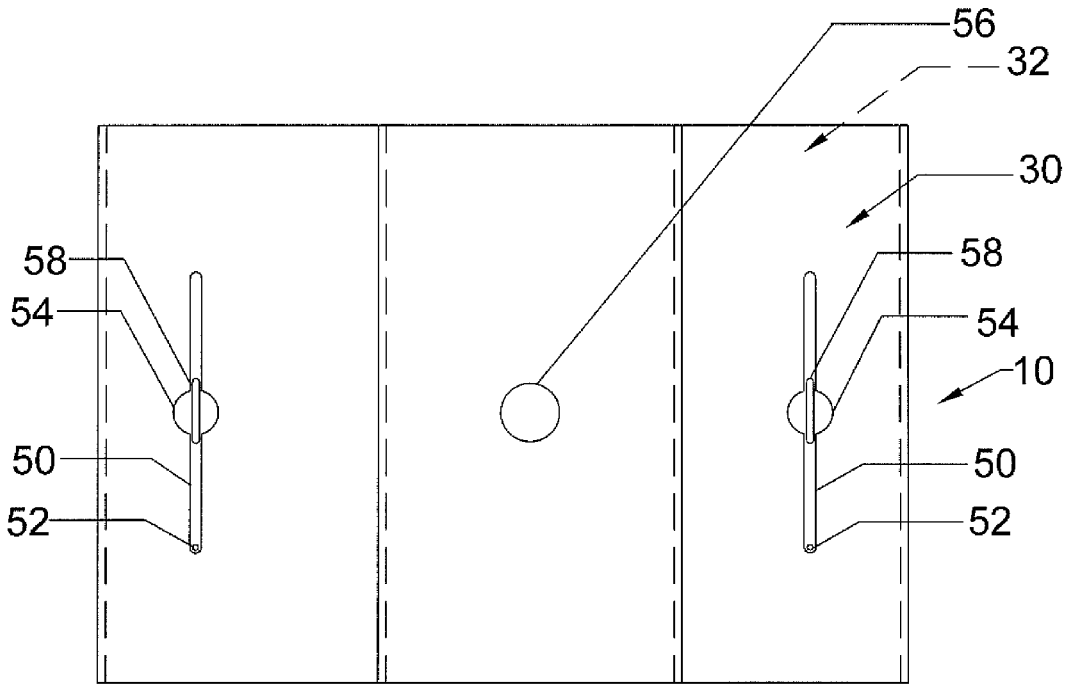
FIG. 5 is a front view of the jamb patch of the apparatus and method for repairing the steel door frame of the present invention in a first position where the second portion is positioned behind the first portion.
Figure 6:
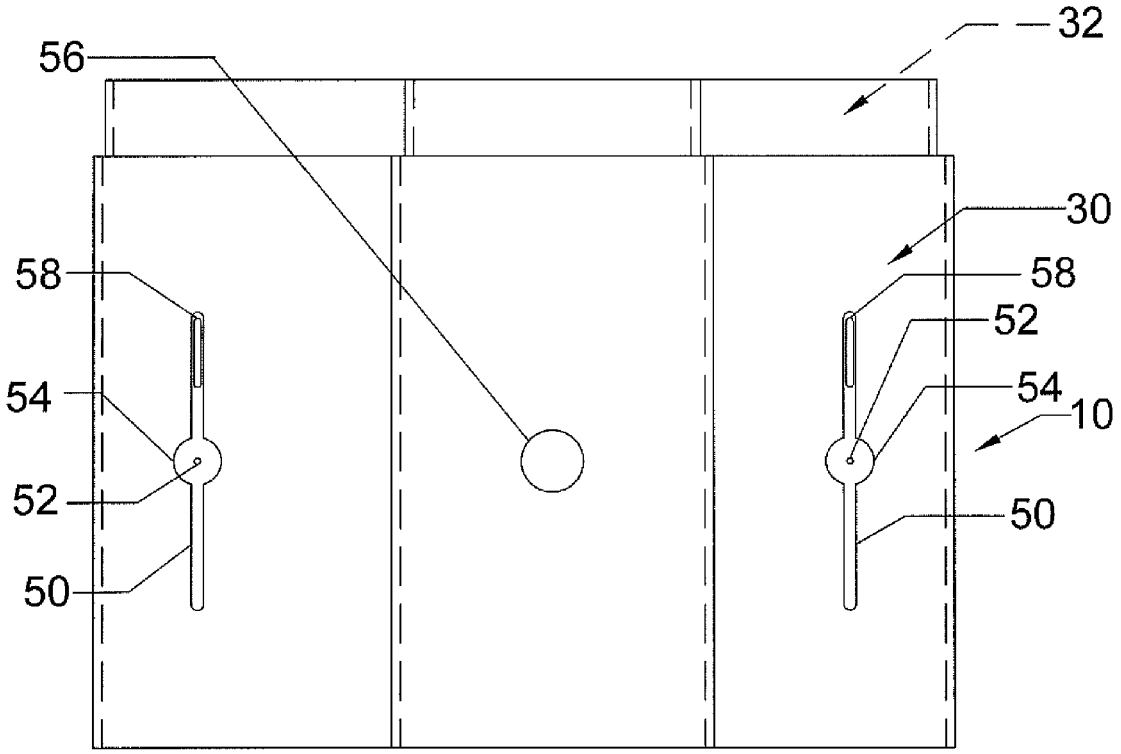
FIG. 6 is a front view of the jamb patch of the apparatus and method for repairing the steel door frame of the present invention in a second position where the second portion extends from the first portion.
Figure 7A:
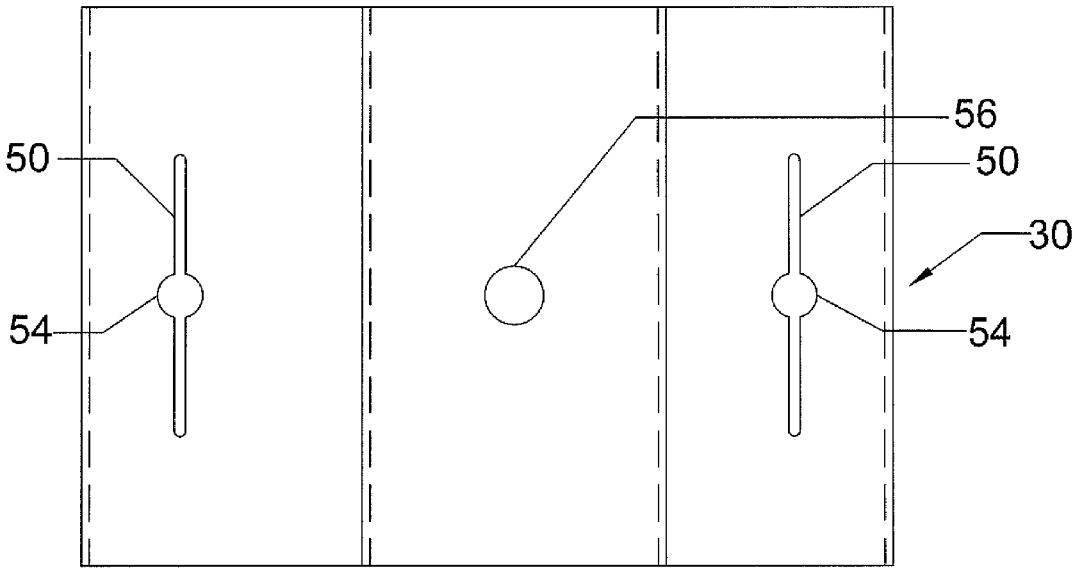
FIG. 7A is a front view of the first portion of the jamb patch of the apparatus and method for repairing the steel door frame of the present invention.
Figure 7B:
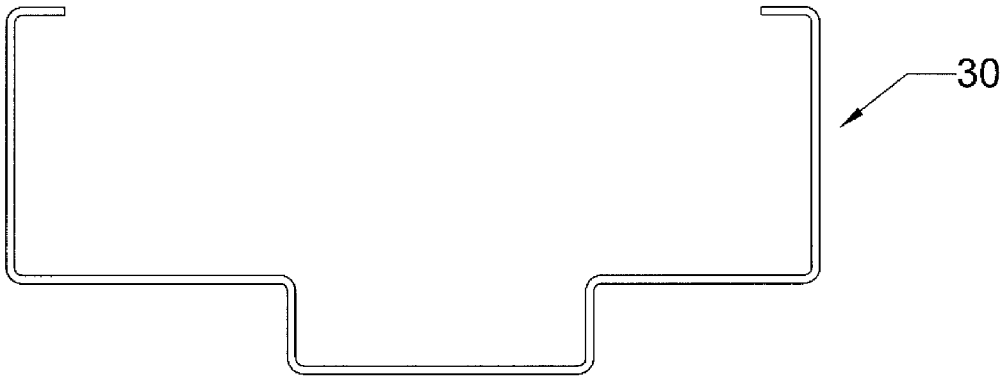
FIG. 7B is a top view of the first portion of the jamb patch of the apparatus and method for repairing the steel door frame of the present invention.
Figure 8A:
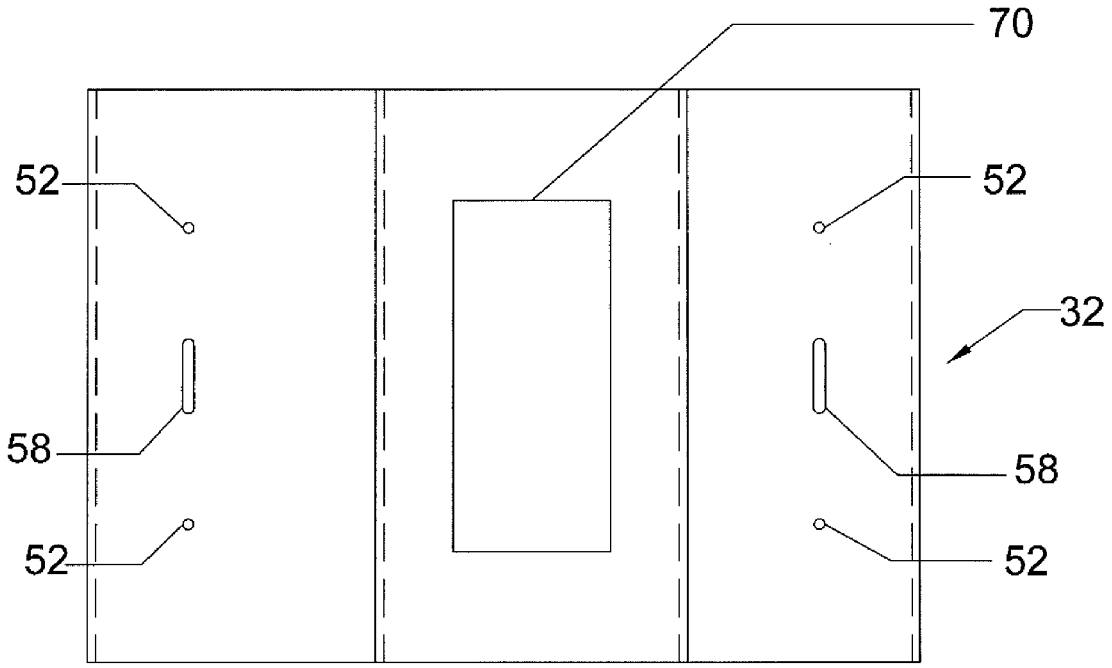
FIG. 8A is a front view of the second portion of the jamb patch of the apparatus and method for repairing the steel door frame of the present invention.
Figure 8B:
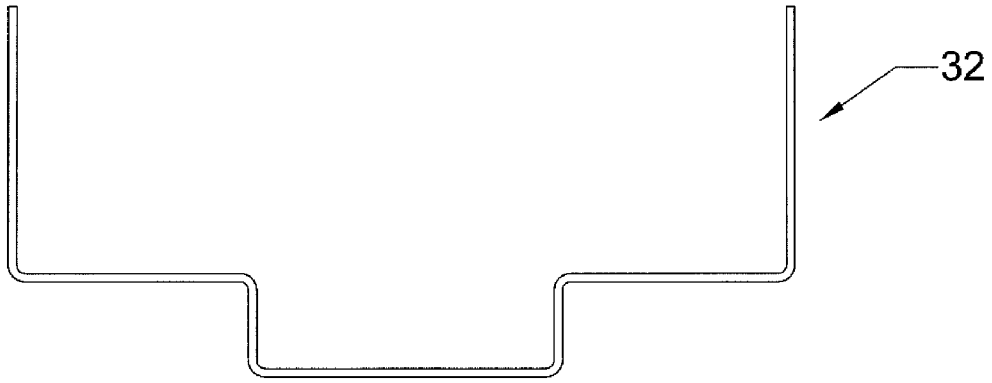
FIG. 8B is a top view of the second portion of the jamb patch of the apparatus and method for repairing the steel door frame of the present invention.

An example of the general construction of the jamb patch 10 of the present invention is shown in FIG. 4, to which additional reference can be made to FIGS. 1, 5, 6, 7A, 7B, 8A, 8B, and 10. The jamb patch 10 generally includes a first portion 30 and a second portion 32 that is coupled to and extends from the first portion 30. The second portion 32 may be coupled to the first portion 30 of the jamb patch 10 in a fixed position, or alternatively, as shown in FIGS. 5 and 6, the second portion 32 may be matingly and slidingly coupled to the first portion 30.

To replace the damaged section 22*a* of the steel door frame 22, the first portion 30 of the jamb patch 10 is placed adjacent to a remaining section 22*b* of the steel door frame 22, such that one end of the first portion 30 abuts an end of the steel door frame 22 to create a substantially flush and continuous steel door frame 22 and first portion 30. The profile of the first portion 30 of the jamb patch 10 is sized and shaped to match the cross-sectional contour of the steel door frame 22. That is, the first portion 30 of the jamb patch 10 has a generally U-shaped configuration, which may be sized and shaped to match the cross-sectional contour of a double rabbet door frame, although in other examples, the first portion 30 of the jamb patch 10 may be sized and shaped to match the cross-sectional contour of a single rabbet, double egress or other door frame. In the illustrated example, where the first portion 30 of the jamb patch 10 is matched to the generally symmetric cross-sectional contour of the steel door frame 22, the jamb patch 10 as a whole has a non-handed configuration. That is, the jamb patch 10 can be rotated 180° for installation, with the second portion 32 extending from the opposite end of the first portion 30 of the jamb patch 10 in the opposite direction.

To assist in supporting the first portion 30 of the jamb patch 10 with the steel door frame 22, the second portion 32 of the jamb patch 10 is configured to extend from the first portion 30 of the jamb patch 10 and fit behind and engage the remaining section 22*b* of the steel door frame 22 when the first portion 30 of the jamb patch 10 is positioned in the place of the damaged section 22*a* of the steel door frame 22. The fitment of the second portion 32 of the jamb patch 10 behind the remaining section 22*b* of the steel door frame 22 assist in aligning the first portion 30 of the jamb patch 10 with the remaining section 22*b* of the steel door frame 22 to achieve a substantially flush and contiguous repaired steel door frame 22. Once the first portion 30 of the jamb patch 10 is positioned and secured in alignment with the remaining section 22*b* of the steel door frame 22, the repair can be aesthetically finished by applying a repair compound (not shown) to a joint area 40 formed between the remaining section 22*b* of the steel door frame 22 and the first portion 30 of the jamb patch 10. It can be seen that the second portion 32 of the jamb patch 10 provides a backing surface for the repair compound, preventing the compound from falling into a cavity of the repaired steel door frame 22 behind the joint area 40 thereby permitting a complete, effective and professional looking repair of the steel door frame 22.

The jamb patch 10 can be configured as shown in FIG. 4, with the second portion 32 extending from a single end of the first portion 30 of the jamb patch 10. This configuration of the jamb patch 10 is applicable, for instance, in replacing a terminal section of the steel door frame 22 (e.g., the bottommost section of the steel door frame 22), where the jamb patch 10 meets the remaining section 22*b* of the steel door frame 22 at only one of its ends when installed. In alternative configurations of the jamb patch 10, the second portion 32 can be configured to extend from both ends of the first portion 30 of the jamb patch 10 (not shown). This configuration could be applicable, for instance, in replacing an interior section of the steel door frame 22 (e.g., a section of the steel door frame 22 including or surrounding the strike or a hinge), where the jamb patch 10 meets the remaining section 22*b* of the steel door frame 22 at both ends of the steel door frame 22 when installed. According to this alternative configuration of the jamb patch 10, the first portion 30 and/or the second portion 32 can optionally include reinforced areas or other features for the attachment of hardware components such as closers and hinges (not shown).

In FIG. 5, the second portion 32 of the jamb patch 10 is in a first, retracted position with respect to the first portion 30 of the jamb patch 10. With the second portion 32 in the retracted position, the first portion 30 of the jamb patch 10 generally overlaps the second portion 32, such that the overall dimensions of the jamb patch 10, and particularly its end to end length, are generally defined by the first portion 30 of the jamb patch 10. This allows the installer of the jamb patch 10 to minimize the removal of material from the steel door frame 22, since the jamb patch 10 can be translated directly into the space vacated by the removed damaged section 22*a* of the steel door frame 22. In the example of the jamb patch 10 where the second portion 32 is coupled to and extends from the first portion 30 of the jamb patch 10 in a fixed position, it will be understood that the installer of the jamb patch 10 would have to give consideration to the clearance needed to rotate the jamb patch 10 in order to fit the second portion 32 behind the remaining section 22*b* of the steel door frame 22 while the first portion 30 of the jamb patch 10 is positioned into the space vacated by the removed damaged section 22*a*.

FIG. 6 shows the second portion 32 of the jamb patch 10 in a second, extended position with respect to the first portion 30 of the jamb patch 10. The second, extended position of the second portion 32 can be achieved once the first portion 30 of the jamb patch 10 is put in place of the damaged section 22*a* of the steel door frame 22, thereby fitting or sliding the second portion 32 of the jamb patch 10 into engagement behind the remaining section 22*b* of the steel door frame 22 and aligning the first portion 30 of the jamb patch 10 with the remaining section 22*b* of the steel door frame 22.

The first portion 30 of the jamb patch 10 may include elongate channels 50 to permit access to the second portion 32 of the jamb patch 10 to allow for sliding the second portion 32 into the second, extended position. The second portion 32 of the jamb patch 10 may include slots 58 that are aligned within the elongate channels 50 to allow a tool, such as a flathead screwdriver, to raise the second portion 32 into the second, extended position. In addition, the first portion 30 of the jamb patch 10 may include apertures 54 to permit the passing of conventional fasteners (not shown), such as screws, to engage and secure the second portion 32 of the jamb patch 10 in the second, extended position. Similarly, the second portion 32 of the jamb patch 10 may include apertures 52 to permit the passing or engagement of the conventional fasteners used to secure the second portion 32 in the second, extended position. The conventional fasteners may extend beyond the jamb patch 10 and into the underlying wall structure 26 of the steel door frame 22 to secure the position of the first portion 30 relative to the second portion 32, as well as the position of the jamb patch 10 as a whole.

Figure 9:
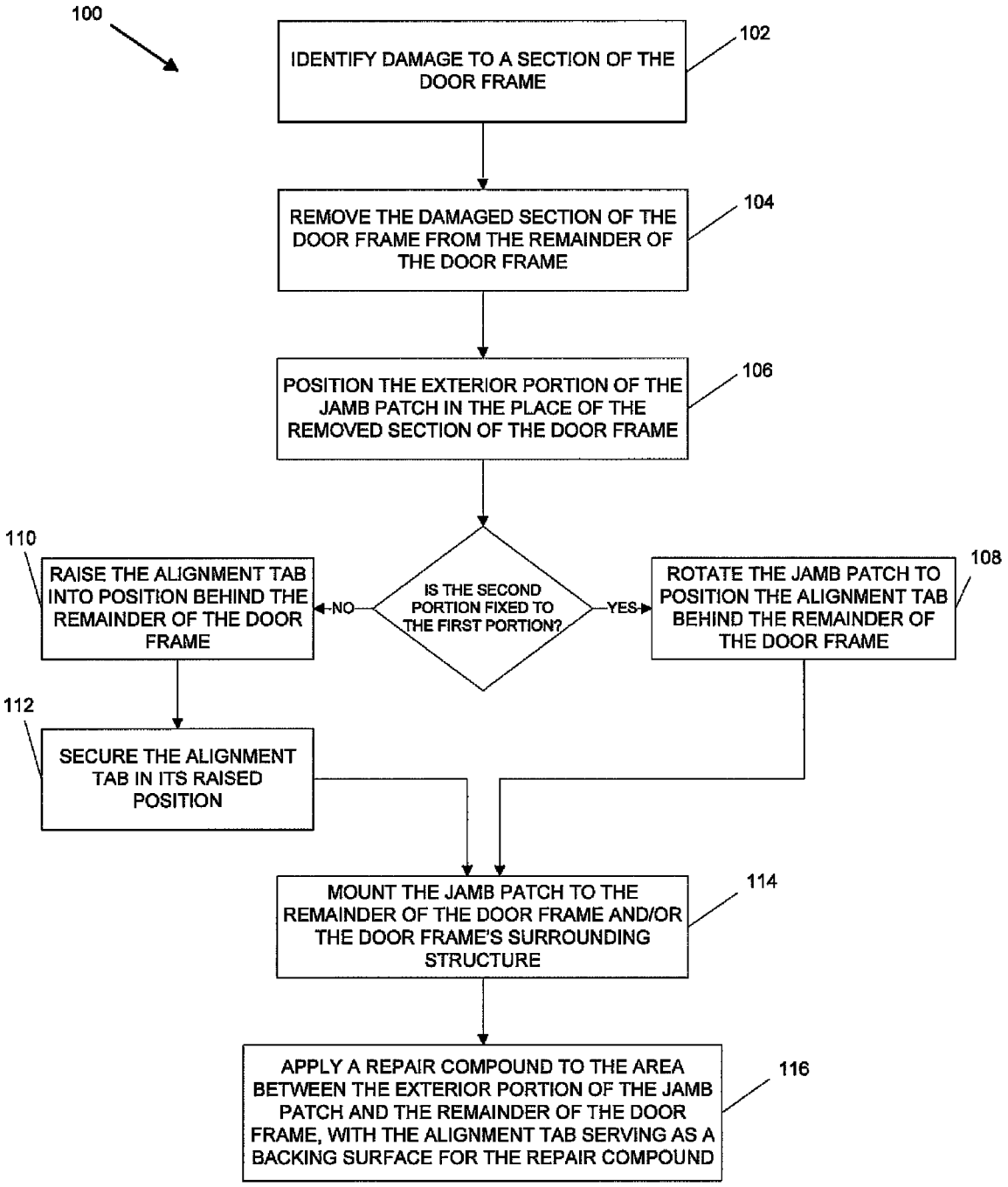
FIG. 9 is a flowchart depicting the method of the present invention for repairing a damaged steel door frame by installing the jamb patch.

The operations of an exemplary process 100 for using the jamb patch 10 to repair damage to the steel door frame 22 are shown in FIG. 9. In operation 102, damage to the steel door frame 22 is identified, and an installer cuts or otherwise removes the damaged section 22*a* of the steel door frame 22, as noted in operation 104. The damaged section 22*a* of the steel door frame 22 must be removed at appropriate points with respect to the steel door frame 22 for the proper fit and placement of the jamb patch 10. If the jamb patch 10 is configured with the second portion 32 coupled to the first portion 30 in sliding engagement, the amount of material removed from the steel door frame 22 can correspond closely to the length of the jamb patch 10. Otherwise, a slight amount of additional material may have to be removed from the steel door frame 22 in consideration of the clearance needed to rotate the jamb patch 10 in order to fit the second portion 32 of the jamb patch 10 behind the remaining section 22*b* of the steel door frame 22 when the second portion 32 is fixed to the first portion 30 of the jamb patch 10 thereby allowing the first portion 30 of the jamb patch 10 to be positioned into the space vacated by the removed damaged section 22*a* of the steel door frame 22. If the section of the steel door frame 22 being removed and replaced includes features for the attachment of hardware components (e.g., closers and hinges), then the installer must take additional care to ensure that the damaged section 22*a* of the steel door frame 22 is removed at appropriate points so that any corresponding attachment features of the jamb patch 10 are properly located at the correct elevation.

Once the damaged section 22*a* of the steel door frame 22 is removed, and the surrounding area is cleaned of debris or any other obstructions that could interfere with the installation of the jamb patch 10, as noted in operation 106, the first portion 30 of the jamb patch 10 is positioned in place of the damaged section 22*a* of the steel door frame 22.

Operation 108 is performed in conjunction with operation 106 for the configuration of the jamb patch 10 where the second portion 32 is coupled to the first portion 30 of the jamb patch 10 in a fixed position. In operation 108, the jamb patch 10 is rotated in order to fit the second portion 32 in position behind the remaining section 22*b* of the steel door frame 22 while the first portion 30 of the jamb patch 10 is positioned into the space vacated by the removed damaged section 22*a* of the steel door frame 22. Following operation 108, the first portion 30 of the jamb patch 10 is aligned with the remaining section 22*b* of the steel door frame 22.

Alternatively, if the jamb patch 10 is configured with the second portion 32 coupled to the first portion 30 in a sliding engagement, operations 110 and 112 are performed subsequently to operation 106. In particular, in operation 110, the second portion 32 of the jamb patch 10 is raised into the second, extended position, thereby fitting the second portion 32 of the jamb patch 10 into engagement behind the remaining section 22*b* of the steel door frame 22 and aligning the first portion 30 of the jamb patch 10 with the remaining section 22*b* of the steel door frame 22. In operation 112, the second portion 32 of the jamb patch 10 is secured in the second, extended position by extending conventional fasteners, such as screws, through the corresponding apertures 54 of the first portion 30 and the second portion 32 of the jamb patch 10.

Figure 10:
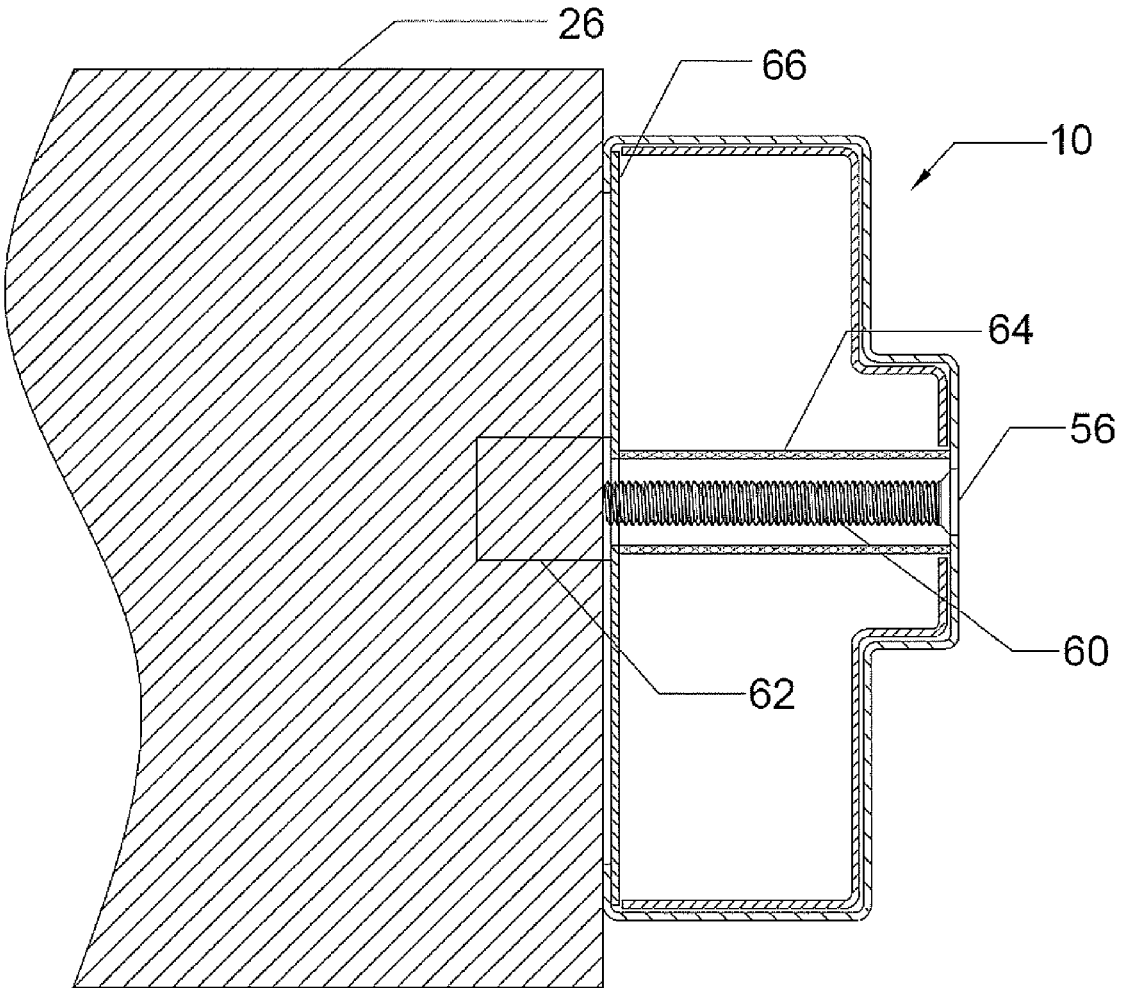
FIG. 10 is a cross sectional view of the jamb patch of the apparatus and method for repairing the steel door frame of the present invention installed in the steel door frame.

Once the jamb patch 10 is in position, as noted in operation 114, the jamb patch 10 is mounted or otherwise secured, for example using appropriate fasteners, to the remaining section 22*b* of the steel door frame 22 and/or to the underlying wall structure 26 surrounding the steel door frame 22 by extending a conventional fastener 60, such as an anchor bolt, through the aperture 56 of the first portion 30 and a corresponding cutout 70 of the second portion 32, as shown in FIG. 10. The corresponding cutout 70 provides clearance for the conventional fastener 60. The conventional fastener 60 may be secured within a wall anchor 62 that extends between the steel door frame 22 and the wall structure 26 surrounding the steel door frame 22 to anchor the jamb patch 10 to the underlying wall structure 26. The first portion 30 of the jamb patch 10 may be provided with a substantially cylindrical tube 64 and a plate 66 that extends between the ends of the first portion 30. The cylindrical tube 64 extends from the aperture 56 to an aperture (not shown) on the plate 66, which allows the conventional fastener 60 to pass through the cylindrical tube 64 and engage the steel door frame 22 and/or the underlying wall structure 26 surrounding the steel door frame 22.

In operation 116, with the jamb patch 10 mounted and the first portion 30 of the jamb patch 10 positioned in alignment with the remaining section 22*b* of the steel door frame 22, a repair compound is applied to the joint area 40 formed between the remaining section 22*b* of the steel door frame 22 and the first portion 30 of the jamb patch 10, using the second portion 32 of the jamb patch 10 as a backing surface for the repair compound. After the repair compound dries, it can be prepared for finish painting, and once the jamb patch 10 and surrounding areas of the remaining section 22*b* of the steel door frame 22 are painted, the installer's repair of the steel door frame 22 is complete.

While recited characteristics and conditions have been described in connection with certain embodiments, it is to be understood that this disclosure is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for repairing a damaged section of a door frame, wherein the door frame has at least one side, wherein each of the at least one side has an axis extending parallel to a length of that side, comprising:

a first portion of a jamb patch having a first configuration adaptable to replace the damaged section of the door frame; and a second portion of the jamb patch having a second configuration coupled to the first portion, wherein the first configuration of the first portion and the second configuration of the second portion are substantially similar in shape and size, the first portion at least partially overlaps the second portion, and the second portion at least partially extends beyond the first portion along the axis of the at least one side of the door frame to fit behind an undamaged section of the door frame to assist in aligning the first portion of the jamb patch with the undamaged section of the door frame.

2. The apparatus of claim 1, wherein the second portion of the jamb patch fixedly extends from the first portion of the jamb patch.

3. The apparatus of claim 1, wherein the second portion of the jamb patch is slidably coupled to the first portion of the jamb patch for movement between a first position, wherein the first portion of the jamb patch overlaps the second portion of the jamb patch, and a second position, wherein the second portion of the jamb patch extends from the first portion of the jamb patch along the axis of the at least one side and at least a portion of the second portion of the jamb patch is not overlapped by the first portion of the jamb patch.

4. The apparatus of claim 3, further comprising:

the first portion of the jamb patch having at least one aperture extending therethrough; and a fastener extending through the at least one aperture for securing the second portion of the jamb patch in the second position.

5. The apparatus of claim 3, further comprising:

the first portion of the jamb patch having at one least one elongate channel to permit access to the second portion of the jamb patch to allow for adjusting the second portion between the first position and the second position.

6. The apparatus of claim 5, further comprising:

the second portion of the jamb patch having at least one slot in alignment with the at least one elongate channel in the first portion to assist with adjusting the second portion between the first position and the second position, wherein the at least one slot has a length less than a length of the at least one elongate channel of the first portion that the slot is aligned with.

7. The apparatus of claim 1, wherein the first portion and the second portion of the jamb patch have substantially U-shaped configurations similar to the undamaged section of the door frame.

8. An apparatus for repairing a damaged door frame comprising:

a first portion of a jamb patch adaptable to replace a removed section of the door frame, wherein the first portion of the jamb patch has a substantially U-shaped configuration similar to a remaining section of the door frame, wherein the U-shaped configuration has a pair of free ends;

a second portion of the jamb patch coupled to the first portion, wherein the second portion is adaptable to fit behind the remaining section of the door frame to assist in aligning the first portion of the jamb patch with the remaining section of the door frame;

a plate connected to the pair of free ends of the first portion of the jamb patch, wherein the plate has an aperture extending therethrough;

the first portion of the jamb patch having an aperture extending therethrough; and a substantially cylindrical tube connected to the plate and the first portion of the jamb patch and extending between and in communication with the aperture of the plate and the aperture of the first portion of the jamb patch, wherein the substantially cylindrical tube is adaptable to receive a fastener to assist with securing the jamb patch in the place of the removed section of the door frame.

9. The apparatus of claim 1, wherein the second portion of the jamb patch provides a surface engageable with a filler compound.

10. An system for repairing a damaged portion of a door frame, wherein an undamaged portion of the door frame remains substantially in place, comprising:

a door frame having a damaged portion, an undamaged portion, and at least connected sides, wherein each of the at least three sides has an axis extending parallel to a length of the side, and wherein the damaged portion of the door frame is along one side from the at least three sides an apparatus comprising a first portion and a second;

the first portion having a first configuration adaptable to replace the damaged portion of the door frame, a pair of free ends, and a longitudinal length less than a longitudinal length of the side of the door frame that the damaged portion is along;

the second portion coupled to the first portion, wherein the second portion has a second configuration, a pair of free ends, and a longitudinal length less than the longitudinal length of the side of the door frame that the damaged portion is along, wherein the first portion at least partially overlaps the second portion, and wherein a portion of the second portion extends from the first portion along the axis of the side of the door frame that the damaged portion is along to fit behind the undamaged portion of the door frame to assist in aligning the first portion with the undamaged portion of the door frame.

11. The system of claim 10, wherein the first configuration of the first portion and the second configuration of the second portion are substantially similar in shape and size.

12. The system of claim 10, wherein the first portion has a substantially U-shaped configuration.

13. The system of claim 10, wherein the second portion is fixedly attached to extends from the first portion.

14. The system of claim 10, wherein the second portion is slidably coupled to the first portion for movement between a first position, where the second portion is entirely overlapped by the first portion, and a second position, where the second portion at least partially extends in a longitudinal direction from the first portion and at least a portion of the second portion is not overlapped by the first portion.

15. The system of claim 10, further comprising:

the first portion having at least one aperture extending therethrough; and a fastener extending through the at least one aperture for securing the second portion to the door frame in the second position.

16. The system of claim 15, the first portion further comprises:

at least one elongate channel to permit access to the second portion to assist with moving between the first position and the second position.

17. The system of claim 16, wherein the second portion further comprises:

at least one slot in communication with the at least one elongate channel of the first portion to assist with moving between the first position and the second position.

18. The system of claim 15, further comprising:

a plate connected to the pair of free ends of the first portion.

19. The system of claim 18, further comprising:

the plate having an aperture extending therethrough; and a substantially cylindrical tube connected to the plate and the first portion and extending between and in communication with the aperture of the plate and the aperture of the first portion, wherein the substantially cylindrical tube is adaptable to receive a fastener to assist with securing the first portion in place of the damaged portion of the door frame.

20. The system of claim 10, wherein the second portion provides a surface engageable with a filler compound.

* * * * *